US006143481A

United States Patent [19]

Uytterhoeven et al.

[11] Patent Number: 6,143,481

[45] **Date of Patent: *Nov. 7, 2000**

[54] PHOTOTHERMOGRAPHIC RECORDING MATERIAL COATED FROM AN AQUEOUS MEDIUM

[75] Inventors: Herman Uytterhoeven, Bonheiden; Yvan Gilliams, Hever, both of Belgium

[73] Assignee: Agfa-Gevaert, Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,764

[22] Filed: Jan. 20, 1998

Related U.S. Application Data

[63] Continuation of application No. PCT/EP96/02581, Jun. 13, 1996.

[30] Foreign Application Priority Data

Jul. 18, 1995 [EP] European Pat. Off. ..... 95201968

[51] Int. Cl.[7] ..... G03C 1/498

[52] U.S. Cl. ..... 430/350; 430/619; 430/531; 430/533

[58] Field of Search ..... 430/619, 617, 430/350, 531, 533

[56] References Cited

U.S. PATENT DOCUMENTS

| | | | |
|---|---|---|---|
| 4,273,723 | 6/1981 | Hayashi et al. | 260/414 |
| 4,504,575 | 3/1985 | Lee | 430/531 |
| 5,264,334 | 11/1993 | Prsezdziecki et al. | 430/523 |

FOREIGN PATENT DOCUMENTS

| | | |
|---|---|---|
| 0386761 | 2/1977 | European Pat. Off. . |
| 0174135 | 3/1978 | European Pat. Off. . |
| 0212534 | 1/1981 | European Pat. Off. . |
| 0439944 | 12/1981 | European Pat. Off. . |
| 2819855 | 6/1986 | Germany . |
| 5828737 | 7/1979 | Japan . |
| 61193142 | 3/1980 | Japan . |
| 2063500 | 4/1976 | United Kingdom . |
| 1362970 | 11/1982 | United Kingdom . |

OTHER PUBLICATIONS

The Condensed Chemical Dictionary, Tenth Edition Revised by Gessner G. Hawley, pp. 601–602, 1981.

Research Disclosure Jul. 1980 (#19551).

*Primary Examiner*—Thorl Chea
*Attorney, Agent, or Firm*—Baker Botts L.L.P.

[57] ABSTRACT

A photothermographic recording material comprising a support and a photo-addressable thermally developable element comprising photosensitive siver halide in catalytic association with a substantially light-insensitive silver salt of an organic carboxylic acid, an organic reducing agent for the substantially light-insensitive silver salt of an aliphatic carboxylic acid in thermal working relationship therewith and a binder, characterized in that the binder comprises a non-proteinaceous water-soluble binder, a non-proteinaceous water-dispersible binder (preferably a comprising a diene, styrene, an acrylate or a methacrylate monomer) or a mixture of a non-proteinaceous water soluble binder and a non-proteinaceous water-dispersible binder and the photo-addressable thermally developable element is capable of being coated from an aqueous medium and is capable of producing images stable to light without a wet-processing step; a process for producing the photothermographic recording material and a photo-thermographic recording process therefor.

9 Claims, 1 Drawing Sheet

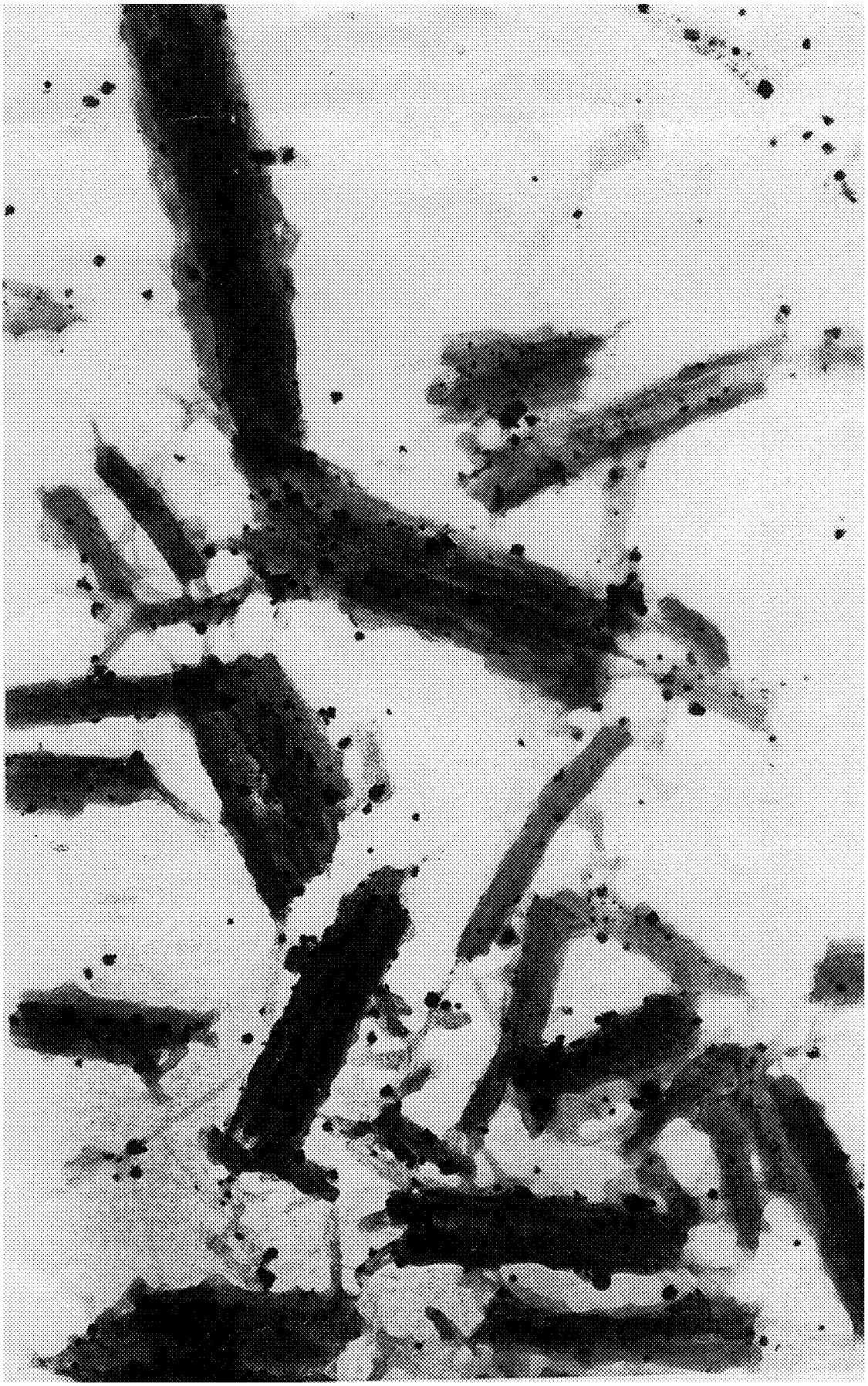

PHOTOTHERMOGRAPHIC RECORDING MATERIAL COATED FROM AN AQUEOUS MEDIUM

This is a continuation of International Application PCT/EP96/02581, with an international filing date of Jun. 13, 1996.

DESCRIPTION

1. Field of the Invention

The present invention relates to a photothermographic recording material comprising a photo-addressable thermally developable element coatable from aqueous media.

2. Background of the Invention

Thermal imaging or thermography is a recording process wherein images are generated by the use of thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element containing other of the ingredients necessary for the chemical or physical process followed by uniform heating to bring about the changes in colour or optical density.

3. Thermal dye transfer printing wherein a visible image pattern is formed by transfer of a coloured species from an imagewise heated donor element onto a receptor element.

Thermographic materials of type 1 can be rendered photothermographic by incorporating a photosensitive agent which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over the sheet, and as the image forming component an oxidation-reduction reaction combination which is substantially latent under ambient conditions and which can be initiated into reaction by the free metal to produce a visible change in colour comprising an organic silver salt containing carbon atoms and different from the heavy metal salt as an oxidizing agent and in addition an organic reducing agent containing carbon atoms, the radiation-sensitive heavy metal salt being present in an amount between about 50 and about 1000 parts per million of the oxidation-reduction reaction combination.

The standard teaching over such photothermographic materials based on a substantially light-insensitive organic silver salt, photosensitive silver halide in intimate catalytic association with the organic silver salt and a reducing agent for the organic silver salt is that the organic silver salt is formed, optionally in the presence of ex situ formed silver halide, in an aqueous medium and is precipitated and dried before dispersion in an organic solvent medium from which the dispersion is coated, the silver halide either being prepared ex situ, and either added to a dispersion of the organic silver salt as described in U.S. Pat. No. 3,080,254 or being present during the formation of the organic silver salt as disclosed in U.S. Pat. No. 3,839,049, or being prepared in situ from the organic silver salt by reaction with a halide ion source as disclosed in U.S. Pat. No. 3,457,075. In the latter case reaction of organic silver salt with a halide ion source, which can be inorganic or organic, occurs after the dispersion of the organic silver salt in a solvent medium and hence the reaction takes place in a non-aqueous medium.

This production method is very inefficient as the organic silver salt after formation in water has to be separated and dried before dispersion in a solvent medium, is environmentally unsound as evaporation of solvent takes place during the coating process and it involves lengthy utilization of plant during the preparation of the organic silver salt dispersion and coating requires costly plant due to the need for solvent explosion prevention measures and solvent recovery to prevent solvent emission to the environment.

Furthermore, it is desirable spectrally to sensitize photosensitive silver halide in water-containing media as this permits the use of a broader range of spectrally sensitizing dyes.

The invention of U.S. Pat. No. 4,529,689 attempts to remedy this deficiency by disclosing a photothermographic film composition comprising (a) a substantially light-insensitive silver sulfinate, (b) a photographic silver halide emulsion, (c) a developing (reducing) agent, and (d) a binder; characterized in that the silver sulfinate is selected from the group consisting of silver hexadecylsulfinate, silver dodecylsulfinate, silver nonylsulfinate, silver 3-phenylpropylsulfinate, and silver cyclohexylsulfinate, and wherein the binder is a latex. In a preferred embodiment, according to U.S. Pat. No. 4,529,689, (a) is silver hexadecylsulfinate, (b) is a chemically sensitized gelatino-silver halide negative or direct positive emulsion, (c) is a phenidone or dimezone moiety, and (d) is an acrylate latex. According to the detailed description of U.S. Pat. No. 4,529,689 representative examples of the latex polymer or copolymer are butylmethacrylate, methylmethacrylate, ethylmethacrylate, polystyrene, methylmethacrylate-acrylic acid etc. Furthermore, in all the examples according to the invention disclosed in U.S. Pat. No. 4,529,689, it is necessary after exposure and thermal development of the photothermographic film composition to fix it for 1 minute with ammonium thiosulfate followed by washing in running water and drying to avoid print up (darkening) of the unexposed areas of the image. This necessity for the wet fixing of the photothermographic film compositions disclosed in the invention examples of U.S. Pat. No. 4,529,689 removes the essential advantage of so-called "Dry Silver" photo-thermographic materials over classical silver halide emulsion materials namely the avoidance of wet processing.

Thus, despite forty years of continuous research in this area, a production method for photothermographic materials based on a substantially light-insensitive organic silver salt, photosensitive silver halide in intimate catalytic association with the organic silver salt and a reducing agent for the organic silver salt which dispenses with these disadvantages of the current teaching, has to our knowledge not yet been developed.

OBJECTS OF THE INVENTION

It is a first object of the invention to provide a photothermographic recording material comprising a photo-addressable thermally developable element with excellent image-forming properties.

It is a second object of the invention to provide a photothermographic recording material comprising a photo-addressable thermally developable element based on a substantially light-insensitive organic silver salt, photosensitive silver halide in catalytic association therewith and an organic reducing agent for the organic silver salt, which is produceable without necessitating intermediate drying of the organic silver salt acid.

It is another object of the invention to provide a photothermographic recording material comprising a photo-addressable thermally developable element based on a substantially light-insensitive organic silver salt, photosensitive silver halide in catalytic association therewith and an organic reducing agent for the organic silver salt, which is coatable from an aqueous medium.

It is a further object of the invention to provide a photothermographic recording material with reduced print up after image formation without a wet processing step.

It is a still further object of the invention to provide a photothermographic recording material not requiring a wet processing step in order to obtain a stable image.

It is a yet a still further object of the invention to provide a recording process for a photothermographic recording material with the above improved characteristics.

Further objects and advantages of the invention will become apparent from the description hereinafter.

SUMMARY OF THE INVENTION

According to the present invention a photothermographic recording material is provided comprising a support and a photo-addressable thermally developable element comprising photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder, characterized in that the binder comprises a non-proteinaceous water-soluble binder, a non-proteinaceous water-dispersible binder or a mixture of a non-proteinaceous water soluble binder and a non-proteinaceous water-dispersible binder. The photo-addressable thermally addressable element is coated from an aqueous medium and is capable of producing stable images without a wet-processing step.

A process is also provided for producing a photothermographic recording material, as referred to above, comprising the steps of: producing a suspension of particles of a substantially light-insensitive silver salt of an organic carboxylic acid; (ii) producing an aqueous dispersion or aqueous dispersions containing ingredients necessary for photothermographic image formation; (iii) coating the aqueous dispersion or aqueous dispersions onto a support.

A photothermographic recording process is further provided comprising the steps of: (i) image-wise exposing a photothermographic recording material, as referred to above, to a source of actinic radiation to which the photothermographic recording material is sensitive; and (ii) thermally developing the image-wise exposed photothermographic recording material.

Preferred embodiments of the present invention are disclosed in the detailed description of the invention.

DETAILED DESCRIPTION OF THE INVENTION

The invention is described hereinafter by way of examples with reference to the accompanying FIGURE wherein:

FIG. 1: shows a transmission electron micrograph at a magnification of 50,000x of the silver behenate/silver bromide dispersion produced in the course of the preparation of invention example 69.

AQUEOUS

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc; glycols e.g. ethylene glycol; glycerine; N-methyl pyrrolidone; methoxypropanol; and ketones e.g. 2-propanone and 2-butanone etc.

WATER-DISPERSIBLE AND WATER-SOLUBLE BINDERS

According to the present invention the photo-addressable thermally developable element comprises a binder comprising a non-proteinaceous water-soluble binder, a non-proteinaceous water-dispersible binder or a mixture of a non-proteinaceous water soluble binder and a non-proteinaceous water-dispersible binder.

In a preferred embodiment of the present invention the binder is a polymer latex. In a particularly preferred embodiment of the present invention the polymer latex is selected from the group consisting of: an aqueous dispersion of a terpolymer consisting of 47.5% by weight of methylmethacrylate, 47.5% by weight of butadiene and 5% by weight of itaconic acid; an aqueous dispersion of a terpolymer consisting of 50% by weight of ethylacrylate, 33.5% by weight of methylmethacrylate and 16.5% by weight of methacrylic acid; an aqueous of a copolymer consisting of 95% by weight of ethylacrylate and 5% by weight of methacrylic acid; and an aqueous dispersion of an short oil urethane alkyd resin emulsion based on lineolic rich fatty acids. The production of polymer latexes is described in the "Kirk-Othmer Encyclopedia of Chemical Technology, Fourth Edition", published by John Wiley & Sons, New York in 1995, pages 51 to 68; "Emulsion Polymerization", by D. C. Blackley, published by Applied Science, London in 1975; contribution by G. Lichti, R. G. Gilbert and D. H. Napper in "Emulsion Polymerization", edited by I. Piirma and published by Academic Press in 1982; and the contribution by D. H. Napper and R. G. Gilbert in "Comprehensive Polymer Science", edited by G. C. Eastmond, A. Ledwith, S. Russo and P. Sigwalt and published by Pergamon Press, New York in 1989.

In a particularly preferred embodiment the binder is a polymer comprising monomer units selected from the group consisting of a diene-monomer and a methacrylate.

In another particularly preferred embodiment the binder is a polymer comprising monomer units selected from the group consisting of styrene and an acrylate.

An important prerequisite in the choice of non-proteinaceous binders, mixtures of non-proteinaceous binders and mixtures of non-proteinaceous binders, according to the present invention, with proteinaceous binders is their ability to form a continuous layer with the other ingredients present.

The water-dispersible binder can be any water-insoluble polymer e.g. water-insoluble cellulose derivatives, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed under the trade name BUTVAR B79 of Monsanto USA and provides a good adhesion to paper and properly subbed polyester supports. It should be noted that there is no clear cut transition between a polymer dispersion and a polymer solution in the case of very small polymer particles resulting in the smallest particles of the polymer being dissolved and those slightly larger being in dispersion.

Examples of suitable water-dispersed polymers, according to the present invention, are: diene-(meth)acrylate-copolymers (BINDER 01 to BINDER 04), styrene-butadiene-copolymers (BINDER 05 to BINDER 10), styrene-(meth)acrylate-copolymers (BINDER 11 to BINDER 16), acrylonitrile-copolymers (BINDER 17 to BINDER 20), (meth)acrylate-copolymers (BINDER 21 to 30), ethene-polymers and copolymers (BINDER 31), chlorinated polymers and polymers of chlorine-containing monomers (BINDER 32 to BINDER 35), polymers and copolymers of vinyl acetate (BINDER 36 to BINDER 40), various polycondensation polymers (BINDER 41 to BINDER 55), epoxy-resins (BINDER 56) and melamine resins (BINDER 57). In the case of commercial products only the main comonomers are given below with their concentrations if known. The binders of these products may contain in addition to the comonomers given below small amounts of copolymerized hydrophilic monomers, such as (meth)acrylic acid, (meth)acrylaiide, maleic acid and substituted maleic acid etc. In addition tensides and plasticizers may be present and the dispersing medium may contain small quantities of water-miscible organic solvent in addition to water.

BINDER 01: copolymer consisting of 45% by weight of methylmethacrylate, 45% by weight of butadiene and 10% by weight of itaconic acid;

BINDER 02: terpolymer consisting of 47.5% by weight of methylmethacrylate, 47.5% by weight of butadiene and 5% by weight of itaconic acid;

BINDER 03: copolymer consisting of 47.5% by weight of methylmethacrylate, 47.5% by weight of isoprene and 5% by weight of itaconic acid;

BINDER 04: copolymer consisting of 50% by weight of methylmethacrylate and 50% by weight of butadiene;

BINDER 05: BAYSTAL™ P2005 from BAYER, a copolymer on the basis of styrene and butadiene;

BINDER 06: BAYSTAL™ P2000 from BAYER, a copolymer on the basis of styrene and butadiene;

BINDER 07: BAYSTAL™ P VP KA8588 from BAYER, a copolymer on the basis of styrene and butadiene;

BINDER 08: BAYSTAL™ P VP KA8588 V1 from BAYER, a copolymer on the basis of styrene and butadiene;

BINDER 09: BAYSTAL™ P1800 from BAYER, a copolymer on the basis of styrene and butadiene;

BINDER 10: BAYSTAL™ P VP KA8525 from BAYER, a copolymer on the basis of styrene and butadiene;

BINDER 11: copolymer consisting of 4.5% by weight of styrene, 48.7% by weight of methylmethacrylate, 20% by weight of methacrylic acid and 26.8% by weight of butylacrylate;

BINDER 12: UCECRYL™ 812B from UCB, a styrene-acrylate-copolymer;

BINDER 13: URAMUL™ XP89SC from DSM, a self-crosslinking styrene-acrylate-copolymer;

BINDER 14: URAMUL™ XP288SC from DSM, a self-crosslinking styrene-acrylate-copolymer;

BINDER 15: URAMUL™ XP341SC from DSM, a self-crosslinking styrene-acrylate-copolymer;

BINDER 16: BAYHYDROL™ VP LS2977E from BAYER, a copolymer on the basis of styrene and methylacrylate;

BINDER 17: ACRALEN™ BS from BAYER, a styrene-butadiene-acrylo-nitrile-copolymer;

BINDER 18: PERBUNAN™ N LATEX 3415M from BAYER, an acrylonitrile-butadiene-methacrylic acid-copolymer;

BINDER 19: EUDERM™ DISPERSION 32A from BAYER, a butylacrylate-acrylonitrile-methacrylic acid-copolymer;

BINDER 20: EUDERM™ DISPERSION 92A from BAYER, a butylacrylate-acrylonitrile-methylmethacrylate-methacrylic acid-copolymer;

BINDER 21: terpolymer consisting of 37% by weight of ethylacrylate, 46.5% by weight of methylmethacrylate and 16.5% by weight of methacrylic acid;

BINDER 22: terpolymer consisting of 50% by weight of ethylacrylate, 33.5% by weight of methylmethacrylate and 16.5% by weight of methacrylic acid;

BINDER 23: copolymer consisting of 95% by weight of ethylacrylate and 5% by weight of methacrylic acid;

BINDER 24: NEOCRYL™ A550 from POLYVINYL CHEMIE, polymethyl-methacrylate;

BINDER 25: MOWILITH™ DM771 from HOECHST, a butylacrylate-methylmethacrylate-copolymer;

BINDER 26: VINNAPAS™ DISPERSION LL990 from WACKER, a (meth)acrylic acid-(meth)acrylate-copolymer;

BINDER 27: BAYHYDROL™ VP LS 2940E from BAYER, an acrylate-polymer containing hydroxy-groups;

BINDER 28: terpolymer consisting of 53% by weight of butylacrylate, 45% by weight of methylmethacrylate and 2% by weight of the sodium salt of 2-acrylamido-2-methyl-1-propane-sulfonic acid;

BINDER 29: ROHAFLOC™ F50 from ROHM & HAAS, an acrylate resin;

BINDER 30: terpolymer consisting of 85% by weight of butyl-methacrylate, 10% by weight of butylacrylate and 5% by weight of N-diaceton acrylamide;

BINDER 31: HORDAMER™ PE02 from HOECHST, a polyethene dispersion;

BINDER 32: HALOFLEX™ 208 from ICI, a chlorinated polyethene latex;

BINDER 33: VINNAPAS™ E DISPERSION CEF19 from WACKER, a vinyl acetate-ethene-vinylchloride-copolymer;

BINDER 34: IXAN™ WA36 from SOLVAY, a vinylidene chloride-containing copolymer;

BINDER 35: IXAN™ WA50 from SOLVAY, a vinylidene chloride-methyl methacrylate-copolymer;

BINDER 36: MOWILITH™ DO25 from HOECHST, polyvinyl acetate with 10.8% dibutyl phthalate as plasticizer and polyvinyl alcohol as emulsifier/stabilizer for the latex;

BINDER 37: MOWILITH™ D50 from HOECHST, polyvinyl acetate with polyvinyl alcohol as emulsifier/stabilizer for the latex;

BINDER 38: MOWILITH™ DHL from HOECHST, polyvinyl acetate with polyvinyl alcohol as emulsifier/stabilizer for the latex;

BINDER 39: S-LEC™ KW1 from SEKISUI, a vinyl acetate, vinyl alcohol-vinyl acetal-copolymer;

BINDER 40: BUTVAR™ DISPERSION RS3120 from MONSANTO, a vinyl butyral-vinyl alcohol-vinyl acetate-copolymer;

BINDER 41: polyester consisting of 26.5 mole % of terephthalic acid, 20 mole % of isophthalic acid, 7 mole % of the sodium salt of sulfo-isophthalic acid and 50 mole % ethene glycol dispersed in water without tensides;

BINDER 42: GEROL™ PS20 from RHONE-POULENC, a terephthalic acid-isophthalic acid-sulfo-isophthalic acid-ethene glycol-diethene glycol-copolyester;

BINDER 43: EASTMAN™ AQ29D from EASTMAN-KODAK, an isophthalic acid-diethene glycol-copolyester;

BINDER 44: EASTMAN™ AQ38D from EASTMAN-KODAK, a copolyester;

BINDER 45: EASTMAN™ AQ55D from EASTMAN-KODAK, an isophthalic acid-sulfo-(iso or tere)phthalic acid-diethene glycol-ethene glycol-copolyester;

BINDER 46: BAYDERM™ FINISH 80UD from BAYER, an aliphatic polyurethane dispersion;

BINDER 47: IMPRANIL™ DLV from BAYER, a polyester urethane dispersion;

BINDER 48: IMPRANIL™ 43056 from BAYER, a polyurethane dispersion;

BINDER 49: IMPRANIL™ 43032 from BAYER, a polyurethane dispersion;

BINDER 50: UNIREZ™ 3372 from UNION CAMP CHEM, a polyamide dispersion based on dissolved fatty acids and alkyldiamines;

BINDER 51: DISPERCOLL™ U42 from BAYER, a polyester urethane;

BINDER 52: DISPERCOLL™ VP KA8464 from BAYER, a polyester urethane;

BINDER 53: URADIL™ AZ600Z42 from DSM, a short oil urethane alkyd resin emulsion, based on lineolic rich fatty acids;

BINDER 54: URADIL™ AZ 601Z44 from DSM, a 40% by weight aqueous dispersion of a short oil urethane alkyd resin emulsion, based on lineolic rich fatty acids;

BINDER 55: SER™ AD FX1010 from SERVO DELDEN, a polyurethane;

BINDER 56: URANOX™ E651GZ51 from DSM, an epoxy resin with 9% DOWANOL™ PM present in the dispersing medium;

BINDER 57: RESYDROL™ WM501 from HOECHST, a melamine-aldehyde resin.

Suitable non-proteinaceous water-soluble polymers, according to the present invention, are: polyvinyl alcohol, polyacrylamide, polyacrylic acid, polymethacrylic acid, polyethyleneglycol, polysaccharides, such as starch, gum arabic and dextran and water-soluble cellulose derivatives are: polymers and copolymers of vinyl acetate (BINDER 58 and BINDER 59), poly(vinyl alcohol) (BINDER 60), poly (ethylene oxide) (BINDER 61) and derivatives of natural products (BINDER 62 to BINDER 64):

BINDER 58 reaction product of succinic acid and S-LEC™ BX from SEKISUI, as described in EP-A 519 591;

BINDER 59: reaction product of succinic acid and BUTVAR™ B98 from MONSANTO, as described in EP-A 519 591;

BINDER 60: POLYVIOL™ WX48 20 from WACKER, a copolymer consisting of 98.5% by weight of vinyl alcohol and 1.5% by weight of vinyl acetate;

BINDER 61: POLYOX™ WSR N10 from UNION CARBIDE, a polyethene oxide;

BINDER 62: gum arabic;

BINDER 63: KLUCEL™ E from HERCULES, cellulose 2-hydroxypropyl-ether;

BINDER 64: CELLULOSE GUM™ 12M8 from HERCULES, sodium salt of cellulose carboxymethylether.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

The non-proteinaceous water-soluble and non-proteinaceous water dispersible binders of the present invention can be used together with proteinaceous binders in the photo-addressable thermally developable element. Suitable proteinaceous binders are: gelatin, modified gelatins such as phthaloyl gelatin, zein etc.

PHOTO-ADDRESSABLE THERMALLY DEVELOPABLE ELEMENT

The photo-addressable thermally developable element, according to the present invention, comprises a substantially light-insensitive silver salt of an organic carboxylic acid, photosensitive silver halide in catalytic association therewith and an organic reducing agent in thermal working relationship with the substantially light-insensitive silver salt of an organic carboxylic acid and a water soluble or water-dispersible binder. The element may comprise a layer system with the silver halide in catalytic association with the substantially light-insensitive silver salt of an organic carboxylic acid, spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive silver salt of an organic carboxylic acid i.e. during the thermal development process the reducing agent and the toning agent, if present, are able to diffuse to the substantially light-insensitive silver salt of an organic carboxylic acid.

LIGHT-INSENSITIVE SILVER SALTS OF ORGANIC CARBOXYLIC ACIDS

Preferred substantially light-insensitive silver salts of organic carboxylic acids produced using the process according to the present invention and used in the thermographic materials, according to the present invention, are silver salts of organic carboxylic acids having as their organic group: aryl, aralkyl, alkaryl or alkyl. For example aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group, as described e.g. in GB-P 1,111,492, may likewise be used to produce a thermally developable silver image.

In a preferred embodiment, according to the present invention, the substantially light-insensitive silver salt of an organic carboxylic acid is a silver salt of a fatty acid.

The term substantially light-insensitive silver salt of an organic carboxylic acid for the purposes of the present invention also includes mixtures of silver salts of organic carboxylic acids.

BINDER TO SILVER SALT OF AN ORGANIC CARBOXYLIC ACID RATIO

The binder to silver salt of an organic carboxylic acid weight ratio is preferably in the range of 0.2 to 6, and the thickness of the recording layer is preferably in the range of 1 to 50 $\mu$m.

PRODUCTION OF PARTICLES OF SILVER SALT OF AN ORGANIC CARBOXYLIC ACID

Particles of the silver salts of organic carboxylic acids are prepared by the reaction of a soluble silver salt with the organic carboxylic acid or a salt thereof.

According to a process, according to the present invention, the suspension of particles of a substantially light-insensitive silver salt of an organic carboxylic acid is produced by simultaneous metered addition of an aqueous solution or suspension of an organic carboxylic acid, or its salt, and an aqueous solution of a silver salt to an aqueous liquid and the metered addition of the aqueous solution or suspension of the organic carboxylic acid or its salt; and/or the aqueous solution of the silver salt is regulated by the concentration of silver ions or the concentration of anions of the silver salt in said aqueous liquid.

This metered addition may be regulated by varying the rate of addition of the solution or suspension of the organic carboxylic acid or its salt; and/or the rate of addition of the solution of the silver salt so as to maintain the value of a physical parameter, that significantly changes upon the addition of the solution or suspension of the organic carboxylic acid or its salt and/or the solution of the silver salt to the liquid, at a particular value predetermined for a particular moment in the process. The value of the physical parameter used to regulate the addition of the solution or suspension of an organic carboxylic acid or its salt and/or the solution of the silver salt to the liquid may vary during the course of the production process.

Furthermore, the physical parameter used to regulate the metered addition of the solution or suspension of the organic carboxylic acid or its salt; and/or the solution of the silver salt, according to the present invention, may be the concentration of silver ions or the concentration of anions of the silver salt in the liquid. Other physical parameters that may be used to regulate the metered addition of the solutions are, for example, the electrical conductivity of the suspending medium, the dielectric constant of the suspending medium, the density of the suspending medium, the pH of the suspending medium etc.

The temperatures of the solution or suspension of the organic carboxylic acid or its salt; the solution of the silver salt; and the liquid are determined by the required characteristics of the particles; and may be kept constant or may be varied during the synthesis of the silver salt of a organic carboxylic acid again depending upon the required characteristics of the particles.

The liquid for suspending the particles may contain a non-ionic or anionic surfactant for the particles. Dispersion agents may also be present in the solution or suspension of the organic carboxylic acid or its salt; and in the solution of the silver salt; may be added via an additional jet during the production process of the suspension of particles containing a substantially light-insensitive silver salt of a organic carboxylic acid; and may be added at the end of the production process.

A process for producing a photothermographic recording material is also provided by the present invention, wherein the process further comprises the step of producing particles of the photosensitive silver halide from excess silver ions associated with particles of the substantially light-insensitive silver salt of an organic carboxylic acid.

The regulated excess of silver ions during the production of the particles may be achieved by maintaining the UAg of the liquid, defined as the potential difference between a silver electrode (of ≧99.99% purity) in the liquid and a reference electrode consisting of a Ag/AgCl-electrode in 3M KCl solution at room temperature connected with the liquid via a salt bridge consisting of a 10% $KNO_3$ salt solution, at 70° C. at at least 380 mV.

During or after completion of the production of the suspension, salts produced during the process and any excess dissolved ions, for example silver ions, may be removed by on-line or off-line desalting processes such as dialysis or ultrafiltration. Desalting of the suspension may also be achieved after completion of the production process by precipitation of the suspension, followed by decantation, washing and redispersion.

Furthermore, the suspending medium may be changed from a hydrophilic to a hydrophobic suspending medium.

A process according to the present invention may be carried out batchwise or in continuous mode in any suitable recipient.

The particles containing a substantially light-insensitive silver salt of an organic carboxylic acid, of the present invention, may contain several molecular species, such as: substantially light-insensitive organic heavy metal salts; photosensitive agents; organic compounds e.g. organic carboxylic acids, dicarboxylic acids etc.; salts of organic compounds e.g. salts of organic carboxylic acids; stabilizers; antifoggants etc., the molecular species being randomly distributed in the particles or incorporated in a predetermined microstructure. The particles may also be used in mixtures with light-insensitive silver salt of an organic carboxylic acid-containing particles prepared using prior art technology.

PHOTOSENSITIVE SILVER HALIDE

The photosensitive silver halide used in the present invention may be employed in a range of 0.1 to 35 mol percent of substantially light-insensitive silver salt of an organic carboxylic acid, with the range of 0.5 to 20 mol percent being preferred and the range of 1 to 12 mol percent being particularly preferred.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

EMULSION OF SILVER SALT OF AN ORGANIC CARBOXYLIC ACID AND PHOTOSENSITIVE SILVER HALIDE

The silver halide may be added to the photo-addressable thermally developable element in any fashion which places it in catalytic proximity to the substantially light-insensitive silver salt of an organic carboxylic acid. Silver halide and the substantially light-insensitive silver salt of an organic carboxylic acid which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the silver salt of an organic carboxylic acid to partially convert the substantially light-insensitive silver salt of an organic carboxylic acid to silver halide as disclosed in U.S. Pat. No. 3,457,075.

According to a preferred embodiment according to the present invention, particles of the photosensitive silver halide in the photo-addressable thermally developable element are uniformly distributed over and between particles of the substantially light-insensitive silver salt of an organic carboxylic acid, at least 80% by number of the photosensitive silver halide particles having a diameter, determined by transmission electron microscopy, of $\leqq 40$ nm.

According to another preferred embodiment according to the present invention, particles of the photosensitive silver halide are produced by a process in which an aqueous emulsion of particles of the substantially light-insensitive silver salt of an organic carboxylic acid react with at least one onium salt with halide or polyhalide anion(s).

According to a process, according to a still further preferred embodiment of the present invention, particles of the photosensitive silver halide are produced from excess silver ions associated with particles of the substantially light-insensitive silver salt of a organic carboxylic acid in an aqueous medium produced by simultaneous metered addition of a solution or suspension of a organic carboxylic acid, or its salt, and a solution of a silver salt to a liquid. Agents used for converting the excess dissolved silver ions into a silver salt may be inorganic halides, such as metallic halides e.g. KBr, KI, $CaBr_2$ , $CaI_2$ etc.; or ammonium halides.

In a further embodiment, according to the present invention, production of the suspension of particles containing a substantially light-insensitive silver salt is immediately followed by the production of silver halide "in-situ" in the same recipient, thereby producing a photosensitive suspension.

The aqueous emulsion of the silver salt of an organic carboxylic acid optionally including photosensitive silver halide can, according to the present invention, also be produced from particles of the silver salt of an organic carboxylic acid optionally containing photosensitive silver halide by dispersing the particles in water in the presence of non-ionic or anionic surfactants or a mixture of non-ionic and anionic surfactants using any dispersion technique known to one skilled in the art such as ball milling, dispersion in a impingement mill (rotor-stator mixer), dispersion in a microfluidizer etc. A combination of dispersion techniques may also be used, for example using a first technique to produce a predispersion and a second technique to produce a fine dispersion.

ONIUM HALIDES AND POLYHALIDES

According to the present invention photosensitive silver halide particles produced by reacting an aqueous dispersion of particles of the substantially light-insensitive silver salt of an organic carboxylic acid with at least one onium salt with halide or polyhalide anions may be present. The halide or polyhalide onium salts, according to the present invention, may be added as solids or solutions or may be formed in the aqueous dispersion of particles of the substantially light-insensitive silver salt by metathesis between a salt with halide or polyhalide anions and onium salts with anions other than halide or polyhalide.

Preferred oniums according to the present invention are organo-phosphonium, organo-sulphonium and organo-nitrogen onium cations, with heterocyclic nitrogen onium (e.g. pyridinium), quaternary phosphonium and ternary sulphonium cations being preferred. Preferred halide anions, according to the present invention, are chloride, bromide and iodide. Preferred polyhalide anions, according to the present invention, consist of chlorine, bromine and iodine atoms.

Onium cations, according to the present invention, may be polymeric or non-polymeric. Preferred non-polymeric onium salts for partial conversion of particles of substantially light-insensitive silver salt of an organic carboxylic acid into photo-sensitive silver halides according to the present invention are:

PC01=3-(triphenyl-phosphonium)propionic acid bromide perbromide

PC02=3-(triphenyl-phosphonium)propionic acid bromide

PC03=3-(triphenyl-phosphonium)propionic acid iodide

The onium salts are present in quantities of between 0.1 and 35 mol % with respect to the quantity of substantially light-insensitive organic silver salt of organic, with quantities between 0.5 and 20 mol % being preferred and with quantities between 1 and 12 mol % being particularly preferred.

ORGANIC REDUCING AGENT

Suitable organic reducing agents for the reduction of said substantially light-insensitive organic heavy metal salts are organic compounds containing at least one active hydrogen atom linked to O, N or C. Particularly suitable organic reducing agents for the reduction the substantially light-insensitive silver salt of an organic carboxylic acid are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annelated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substiuent is an amino-group.

In preferred reducing agents, the ring atoms of the non-sulfo-substituted 6-membered aromatic or heteroaromatic ring compound consist of nitrogen and carbon ring atoms and the non-sulfo-substituted 6-membered aromatic or heteroaromatic ring compound is annelated with an aromatic or heteroaromatic ring system.

In further preferred reducing agents, the non-sulfo-substituted 6-membered aromatic or heteroaromatic ring compound is substituted with one or more of the following substituents which may also be substituted: alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl.

Particularly preferred reducing agents are substituted catechols or substitued hydroquinones with 3-(3',4'-dihydroxyphenyl)propionic acid, 3',4'-dihydroxybutyrophenone, methyl gallate, ethyl gallate and 1,5-dihydroxy-naphthalene being especially preferred.

During the thermal development process the reducing agent must be present in such a way that it is able to diffuse to the substantially light-insensitive silver salt of an organic carboxylic acid particles so that reduction of the substantially light-insensitive silver salt of an organic carboxylic acid can take place.

AUXILIARY REDUCING AGENTS

The above mentioned reducing agents, regarded as primary or main reducing agents, may be used in conjunction with so-called auxiliary reducing agents. Auxiliary reducing agents that may be used in conjunction with the above mentioned primary reducing agents are organic reducing metal salts, e.g. stannous stearate described in U.S. Pat. Nos. 3,460,946 and 3,547,648.

SPECTRAL SENSITIZER

According to a preferred embodiment of the present invention, the photo-addressable thermally developable element of the photothermographic recording material further comprises a dye with maximum absorbance in the wavelength range 600 to 1100 nm.

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infrared radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

THERMAL SOLVENTS

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in a solid state in the recording layer at temperatures below 50° C., but becomes a plasticizer for the recording layer where thermally heated and/or a liquid solvent for at least one of the redox-reactants, e.g. the reducing agent for the substantially light-insensitive silver salt of an organic carboxylic acid, at a temperature above 60° C. Useful for the purpose are the polyethylene glycols having a mean molecular weight in the range of 1,500 to 20,000 described in U.S. Pat. No. 3,347,675. Other suitable heat solvents are compounds such as urea, methyl sulfonamide and ethylene carbonate as described in U.S. Pat. No. 3,667,959; compounds such as tetrahydro-thiophene-1,1-dioxide, methyl anisate and 1,10-decanediol as described in Research Disclosure 15027 published in December 1976; and those described in U.S. Pat. No. 3,438,776, U.S. Pat. No. 4,740,446, U.S. Pat. No. 5,368,979, EP-A 0 119 615, EP-A 122 512 and DE-A 3 339 810.

TONING AGENTS

In order to obtain a neutral black image tone in the higher densities and neutral grey in the lower densities, photothermographic materials according to the present invention may contain one or more toning agents. The toning agents should be in thermal working relationship with the substantially light-insensitive silver salts of organic carboxylic acids and reducing agents during thermal processing. Any known toning agent from thermography or photothermography may be used.

Suitable toning agents are succinimide and the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type within the scope of following general formula are described in GB-P 1,439,478 and U.S. Pat. No. 3,951,660:

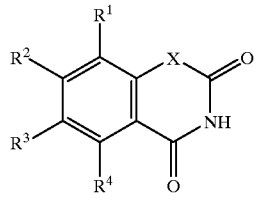

in which:

X represents O or N-alkyl;

each of $R^1$, $R^2$ , $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with p referably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring.

A toner compound, according to the above general formula, particularly suited for use in combination with polyhydroxy benzene reducing agents is benzo [e] [1, 3] oxazine-2,4-dione.

STABILIZERS AND ANTIFOGGANTS

In order to obtain improved shelf-life and reduced fogging, stabilizers and antifoggants may be incorporated into the photothermographic materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

SURFACTANTS

Non-ionic, cationic or anionic surfactants may be used, according to the present invention, to produce dispersions of particles of the substantially light-insensitive silver salt of an organic carboxylic acid in aqueous media and to disperse water-dispersible binders, such as polymer latexes, in aqueous media. A mixture of non-ionic and anionic surfactacts, of non-ionic and cationic surfactants, of cationic and anionic surfactants or of non-ionic, cationic and anionic surfactants may also be used, according to the present invention.

In one embodiment of the present invention the surfactant is an anionic surfactant. In a preferred embodiment of the present invention the anionic surfactant is a sulfonate e.g. alkyl, aryl, alkaryl or aralkyl sulfonate, with alkyl and aryl sulfonates being particularly preferred.

In a further embodiment of the present invention the ionic surfactant is a non-ionic surfactant for example alkyl, aryl, alkaryl or aralkyl polyethoxy ethanols. Preferred non-ionic surfactants, according to the present invention, are alkoxy-polyethoxy ethanols and alkaryloxy-polyethoxy ethanols.

ADDITIONAL INGREDIENTS

In addition to the ingredients the photothermographic recording material may contain other additives such as free organic carboxylic acids, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG—GERMANY), ultraviolet light absorbing compounds, white light reflecting and/or ultraviolet radiation reflecting pigments, silica, and/or optical brightening agents.

ANTIHALATION DYES

In addition to the ingredients, the photothermographic recording material of the present invention may contain anti-halation or acutance dyes which absorb light which has passed through the photosensitive layer, thereby preventing its reflection. Such dyes may be incorporated into the photo-addressable thermally developable element or in any other layer comprising the photothermographic recording material of the present invention. The anti-halation dye may also be bleached either thermally during the thermal development process, as disclosed in the U.S. Pat. Nos. 4,033,948, 4,088,497, 4,153,463, 4,196,002, 4,201,590, 4,271,263, 4,283,487, 4,308,379, 4,316,984, 4,336,323, 4,373,020, 4,548,896, 4,594,312, 4,977,070, 5,258,274, 5,314,795 and 5,312,721, or photo-bleached after removable after the thermal development process, as disclosed in the U.S. Pat. Nos. 3,984,248, 3,988,154, 3,988,156, 4,111,699 and 4,359,524. Furthermore the anti-halation layer may be contained in a layer which can be removed subsequent to the exposure process, as disclosed in U.S. Pat. No. 4,477,562 and EP-A 491 457. Suitable anti-halation dyes for use with infra-red light are described in the EP-A's 377 961 and 652 473, the EP-B's 101 646 and 102 781 and the U.S. Pat. Nos. 4,581,325 and 5,380,635.

SUPPORT

The support for the photothermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the recording material and the paper base substrate.

The support may be in sheet, ribbon or web form and subbed if needs be to improve the adherence to the thereon coated heat-sensitive recording layer.

Suitable subbing layers for improving the adherence of the thermosensitive element and the antistatic layer outermost backing layer of the present invention for polyethylene terephthalate supports are described e.g. in GB-P 1,234,755, U.S. Pat. Nos. 3,397,988; 3,649,336; 4,123,278 and U.S. Pat. No. 4,478,907 which relates to subbing layers applied from aqueous dispersion of sulfonated copolyesters, and further the subbing layers described in Research Disclosure published in Product Licensing Index, July 1967, p. 6.

Suitable pretreatments of hydrophobic resin supports are, for example, treatment with a corona discharge and/or attack by solvent(s), thereby providing a micro-roughening.

The support may be made of an opacified resin composition, e.g. polyethylene terephthalate opacified by means of pigments and/or micro-voids, and/or may be coated with an opaque pigment-binder layer, and may be called synthetic paper, or paperlike film. Information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

PROTECTIVE LAYER

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

This protective layer may have the same composition as an anti-sticking coating or slipping layer which is applied in thermal dye transfer materials at the rear side of the dye donor material or protective layers used in materials for direct thermal recording.

The protective layer preferably comprises a binder, which may be solvent soluble (hydrophobic), solvent dispersible, water soluble (hydrophilic) or water dispersible. Among the hydrophobic binders polycarbonates as described in EP-A 614 769 are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

A protective layer according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol organic carboxylic acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol and organic carboxylic acids. Suitable slipping layer compositions are described in e.g. EP 138483, EP 227090, U.S. Pat. Nos. 4,567,113, 4,572,860 and 4,717,711 and in EP-A 311841.

A suitable slipping layer being a layer comprising as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Other suitable protective layer compositions that may be applied as slipping (anti-stick) coating are described e.g. in published European patent applications (EP-A) 0 501 072 and 0 492 411.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

ANTISTATIC LAYER

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

COATING TECHNIQUES

The coating of any layer of the photothermographic materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

RECORDING PROCESS

Photothermographic materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermo-graphic recording materials, according to the present invention, any sort of heat source can be used that enables the recording materials to be uniformly heated to the development temperature in a time acceptable for the application concerned e.g. contact heating, radiative heating, microwave heating etc.

APPLICATIONS

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

The following ingredients in addition to those mentioned above were used in the photothermographic recording materials of the examples and comparative examples illustrating this invention:

GELATIN 01: type K7598 from AGFA GELATINFABRIK vorm. KOEPFF & SOEHNE (a low viscosity gelatin)

GELATIN 02: type K16353 from AGFA GELATINFABRIK vorm. KOEPFF & SOEHNE (a high viscosity gelatin)

TMOS: tetramethylorthosilicate

The following examples and comparative examples illustrate the present invention. The percentages and ratios used in the examples are by weight unless otherwise indicated.

COMPARATIVE EXAMPLE 1

Extrapolation of the state of the art regarding photothermographic materials based on organic silver sulfinates disclosed in U.S. Pat. No. 4,529,689 to photothermographic materials based on silver salts of organic carboxylic acids:

SILVER HEAXADECYLSULFINATE DISPERSION 5 g of silver hexadecylsulfinate was mixed with 12.5 mL of a 10% by weight aqueous solution of the non-ionic surfactant NON 03 and 82.5 g of deionized water in a ball mill to produce a fine and stable dispersion of silver hexadecylsulfinate.

Partial conversion to photosensitive silver bromide and coating, drying and processing of the photothermographic material EXPERIMENT A (=Invention example 13 in U.S. Pat. No. 4,529,689):

The following ingredients were added with stirring to 6.8 g of the silver hexadecylsulfinate dispersion: 1 g of a 20% by weight aqueous dispersion of BINDER 02 (a latex used in the invention examples of U.S. Pat. No. 4,529,689), 0.4 g of a 0.15 N aqueous solution of potassium bromide (to convert partially the silver hexadecyl-sulfinate to silver bromide) and 1.44 g of a 5% methanolic solution of 4-methyl-1-phenyl-pyrazolidin-3-one (Phenidone B).

A subbed polyethylene terephthalate support having a thickness of 100 μm was then doctor blade-coated with the resulting silver hexadecylsulfinate/silver bromide dispersion to a wet layer thickness of 90 μm. After drying for several minutes at 40° C. on the coating bed, the dispersion layer was dried for 1 hour in a hot air drying cupboard at 50° C. in the dark.

EXPERIMENT B:

The following ingredients were added with stirring to 6.8 g of the silver hexadecylsulfinate dispersion: 1 g of a 20% aqueous dispersion of BINDER 02 (a latex used in the invention examples of U.S. Pat. No. 4,529,689), 0.6 g of a 5% aqueous solution of GELATIN 02 at 40° C. and 0.4 g of a 0.15 N aqueous solution of potassium bromide (to convert partially the silver hexadecyl-sulfinate to silver bromide).

A subbed polyethylene terephthalate support having a thickness of 100 μm was then doctor blade-coated with the resulting silver hexadecyl-sulfinate/silver bromide dispersion to a wet layer thickness of 90 μm. After drying for several minutes at 40° C. on the coating bed, the dried layer was coated with a 2.5% methanolic solution of 4-methyl-1-phenyl-pyrazolidin-3-one (Phenidone B). After drying on the coating bed, the resulting layer was dried for 1 hour in a hot air drying cupboard at 50° C. in the dark.

EXPERIMENT C:

EXPERIMENT C was carried out as described above for EXPERIMENT B, except that the addition of the 5% solution of GELATIN 02 was omitted.

EXPERIMENT D:

EXPERIMENT D was carried out as described for EXPERIMENT C, except that the quantity of the 20% aqueous dispersion of BINDER 02 was increased from 1 g to 4.2 g.

IMAGE-WISE EXPOSURE AND THERMAL PROCESSING

The photothermographic materials produced in experiments A, B, C and D of COMPARATIVE EXAMPLE 1 were then exposed to ultra-violet light through a test original in contact with the material in an Agfa-Gevaert™ DL 2000 exposure apparatus followed by heating on a heated metal block for 10s at 95° C. to produce a very good image with a high contrast and good sharpness. The quality of the images obtained was assessed qualitatively and awarded a numerical score between 0 and 5 where these values correspond to:

0=no image

1=a very weak image

2=a weak image

3=a moderate image quality

4=a good image

5=a very good image with high contrast and good sharpness

The photothermographic materials from EXPERIMENTS A, B, C and D all exhibited a noticeably increased optical density after coating and drying. Image-wise exposure followed by thermal processing produced an increase in optical density, but without image discrimination for all the materials. All materials of EXPERIMENTS A, B, C and D were, therefore, all awarded a score of 0 for image quality.

The very poor imaging results obtained with the photothermographic materials of COMPARATIVE EXAMPLE 1 make the use of non-proteinaceous binders used in the invention examples of U.S. Pat. No. 4,529,689 for other silver salt of an organic carboxylic acids such as the silver salts of organic carboxylic acids of the present invention not obvious to one skilled in the art.

COMPARATIVE EXAMPLE 2

Extrapolation of the state of the art regarding photothermographic materials based on organic silver sulfonates disclosed in U.S. Pat. No. 4,504,575 to photothermographic materials based on silver salts of organic carboxylic acids.

SILVER HEAXADECYLSULFONATE DISPERSION 5 g of silver hexadecylsulfonate was mixed with 12.5 mL of a 10% by weight aqueous solution of the non-ionic surfactant NON 03 and 82.5 g of deionized water in a ball mill to produce a fine and stable dispersion of silver hexadecylsulfinate.

Partial conversion to photosensitive silver bromide and coating, drying and processing of the photothermographic material

EXPERIMENT A:

EXPERIMENT A was carried out as described above for EXPERIMENT B of COMPARATIVE EXAMPLE 1, except that silver hexadecylsulfonate was substituted for silver hexadecylsulfinate.

EXPERIMENT B:

EXPERIMENT B was carried out as described above for EXPERIMENT A, except that the addition of the 5% solution of GELATIN 02 was omitted.

EXPERIMENT C:

EXPERIMENT C was carried out as described for EXPERIMENT B, except that the quantity of the 20% aqueous dispersion of BINDER 02 was increased from 1 g to 4.2 g.

IMAGE-WISE EXPOSURE AND THERMAL PROCESSING

The photothermographic materials produced in experiments A, B and C of COMPARATIVE EXAMPLE 2 were then image-wise exposed and thermally processed as described for the photothermographic materials of COMPARATIVE EXAMPLE 1. The quality of the images obtained was assessed qualitatively as also described for the photothermographic materials of COMPARATIVE EXAMPLE 1.

The photothermographic materials from EXPERIMENTS A, B and C all exhibited a noticeably increased optical density after coating and drying. Image-wise exposure followed by thermal processing produced an increase in optical density, but only the photothermographic material of EXPERIMENT C exhibited any image discrimination and then only with poor contrast. The materials of EXPERIMENTS A, B and C were, therefore, awarded score of 0, 0 and 1 respectively for image quality.

The very poor imaging results obtained with the photothermographic materials of COMPARATIVE EXAMPLE 2 make the use of non-proteinaceous binders such as the latex BINDER 57 used in the invention examples of U.S. Pat. No. 4,504,575 for the coating of other silver salt of an organic carboxylic acids such as the silver salts of organic carboxylic acids of the present invention from aqueous media, not obvious to one skilled in the art.

COMPARATIVE EXAMPLES 3 to 5

In situ preparation of a silver behenate/silver halide-emulsion

Silver behenate was prepared by dissolving 34 g (0.1 moles) of behenic acid in 340 mL of 2-propanol at 65° C., converting the behenic acid to sodium behenate by adding 400 mL of 0.25 M aqueous sodium hydroxide to the stirred behenic acid solution and finally adding 250 mL of 0.4 M aqueous silver nitrate the silver behenate precipitating out. This was filtered off and then washed with a mixture of 10% by volume of 2-propanol and 90% by volume of deionized water to remove residual sodium nitrate.

After drying at 45° C. for 12 h, the silver behenate was dispersed in deionized water with the anionic dispersion agents Ultravon™ W and Mersolat™ H to produce after rapid mixing to a predispersion and homogenization with a microfluidizer a finely divided and stable dispersion containing 20% by weight of silver behenate, 2.1% by weight of Ultravon™ W and 0.203% by weight of Mersolat™ H. The pH of the resulting dispersion was adjusted to about 6.5.

Partial conversion to photosensitive silver halide and coating, drying and processing of the photothermographic material For the material of comparative example 3, the following ingredients were then added to 1.5 g of the silver behenate dispersion: 3 g of a 10% by weight solution of GELATIN 01, 1 g of a 2.2% by weight solution of PCO [3-(triphenylphosphonium)propionic acid bromide] at a pH of 4 (i.e. ca. 8 mol % vs silver behenate) and 1 g of a 4.5% by weight solution of 3-(3,4-dihydroxyphenyl)propionic acid at a pH of 4. Prior to coating the resulting dispersion was diluted to a weight of 9.5 g with deionized water.

A subbed polyethylene terephthalate support having a thickness of 100 μm was then doctor blade-coated with the resulting silver behenate/silver bromide dispersion at a blade setting of 120 μm. The resulting thermographic material was first allowed to dry on the coating bed for several minutes at 40° C. and then was dried for 1 hour in a hot air oven at 50° C.

The material of comparative example 4 was prepared as described for that of comparative example 3 except that after drying the emulsion layer several minutes at 40° C. on the coating bed, the emulsion layer was coated with a 5% by weight aqueous solution of chromium acetate (a hardener for gelatin) at a blade setting of 30 μm. The resulting thermographic material of comparative example 5 was then hardened for 1 hour in a hot air oven at 50° C.

The material of comparative example 5 was prepared as described for that of comparative example 3 except that GELATIN 02 was used instead of GELATIN 01.

Image-wise exposure and thermal processing of the materials of comparative examples 3 to 5 were carried out as described for comparative example 1 and the results are summarized in table 1 below:

TABLE 1

| | Binder added to siver behenate emulsion | | | | | Image quality obtained |
|---|---|---|---|---|---|---|
| Comparative example number | Binder number | solids wt % in medium in which binder is added | pH of binder dispersion | quantity of binder added [g] | Emulsion layer additive | after image-wise exposure and thermal processing |
| 3 | GELATIN 01 | 10 | 5.1 | 0.3 | — | 1 |
| 4 | GELATIN 01 | 10 | 5.1 | 0.3 | chromium acetate | 1 |
| 5 | GELATIN 02 | 10 | 5.1 | 0.3 | — | 1 |

INVENTION EXAMPLES 1 to 64

The materials of invention examples 1 to 64 were prepared as described for comparative example 4 except that the 3 g of a 10% by weight solution of GELATIN 01 was replaced by the binder and quantity of binder for the corresponding example in table 2. Table 2 also gives the % by weight of the binder in the dispersion medium in which the binder was added together with the pH of the binder dispersion.

TABLE 2

| Invention example number | Binder added to siver behenate emulsion: Binder number(s) | solids wt % in medium in which binder is added | pH of binder dispersion | quantity of binder added [g] | Emulsion layer additive(s) | Image quality obtained after image-wise exposure and thermal processing |
|---|---|---|---|---|---|---|
| 1 | 01 | 10 | 4.2 | 0.3 | — | 5 |
| 2 | 01 | 30 | 4.2 | 0.3 | — | 5 |
| | 29 | 2 | 4.2 | 0.012 | | |
| 3 | 01 | 30 | 4.2 | 0.3 | — | 5 |
| | 29 | 2 | 4.2 | 0.03 | | |
| 4 | 01 | 30 | 4.2 | 0.3 | — | 4 |
| | 60 | 10 | 4.2 | 0.1 | | |
| 5 | 02 | 10 | 3.5 | 0.3 | — | 4 |
| 6 | 03 | 10 | 4.0 | 0.3 | — | 5 |
| 7 | 04 | 10 | 4.5 | 0.3 | — | 3 |
| 8 | 05 | 10 | 4.8 | 0.3 | — | 5 |
| 9 | 06 | 10 | 4.2 | 0.3 | — | 5 |
| 10 | 07 | 10 | 4.7 | 0.3 | — | 5 |
| 11 | 08 | 10 | 4.8 | 0.3 | — | 5 |
| 12 | 09 | 10 | 5.4 | 0.3 | — | 5 |
| 13 | 10 | 10 | 5.4 | 0.3 | — | 5 |
| 14 | 11 | 10 | 4.7 | 0.3 | — | 5 |
| 15 | 12 | 10 | 5.0 | 0.3 | — | |
| 16 | 13 | 10 | 5.4 | 0.3 | butylglycol-acetate | 5 |
| 17 | 14 | 10 | 4.4 | 0.3 | — | 5 |
| 18 | 15 | 10 | 4.4 | 0.3 | — | 4 |
| 19 | 16 | 10 | 5.7 | 0.3 | — | 5 |
| 20 | 17 | 10 | 5.2 | 0.3 | — | 5 |
| 21 | 18 | 10 | 5.9 | 0.3 | — | 3 |
| 22 | 19 | 10 | 4.8 | 0.3 | — | 5 |
| 23 | 20 | 10 | 5.5 | 0.3 | — | 5 |
| 24 | 21 | 10 | 3.6 | 0.3 | — | 5 |
| 25 | 22 | 10 | 4.1 | 0.3 | — | 5 |
| 26 | 24 | 10 | 4.9 | 0.3 | — | 4 |
| 27 | 25 | 10 | 5.2 | 0.3 | — | 5 |
| 28 | 26 | 10 | 5.3 | 0.3 | — | 4 |
| 29 | 27 | 10 | 5.2 | 0.3 | — | 4 |
| 30 | 28 | 10 | 3.9 | 0.3 | — | 3 |
| 31 | 30 | 10 | 3.3 | 0.3 | — | 4 |
| 32 | 31 | 10 | 3.5 | 0.3 | — | 3 |
| 33 | 32 | 10 | 4.0 | 0.3 | — | 4 |
| 34 | 33 | 10 | 3.9 | 0.3 | — | 4 |
| 35 | 34 | 10 | 3.3 | 0.3 | — | 4 |
| 36 | 35 | 10 | 3.7 | 0.3 | — | 3 |
| 37 | 36 | 10 | 3.6 | 0.3 | polyvinyl alcohol + dibutyl phthalate | 3 |
| 38 | 37 | 10 | 4.2 | 0.3 | polyvinyl alcohol | 4 |
| 39 | 38 | 10 | 4.0 | 0.3 | — | 5 |
| 40 | 40 | 10 | 8.8 | 0.3 | plasticizer (40% by wt) | 3 |
| 41 | 41 | 10 | 5.9 | 0.3 | — | 3 |
| 42 | 42 | 10 | 3.8 | 0.3 | — | 4 |
| 43 | 43 | 10 | 5.2 | 0.3 | — | 3 |
| 44 | 44 | 10 | 5.9 | 0.3 | — | 3 |
| 45 | 45 | 10 | 5.1 | 0.3 | — | 3 |
| 46 | 46 | 10 | 5.7 | 0.3 | — | 3 |
| 47 | 47 | 10 | 4.4 | 0.3 | — | 3 |
| 48 | 48 | 10 | 4.6 | 0.3 | N-methyl-pyrrolodone (4%) | 3 |
| 49 | 49 | 10 | 4.3 | 0.3 | — | 3 |
| 50 | 51 | 10 | 5.9 | 0.3 | — | 4 |
| 51 | 52 | 10 | 4.1 | 0.3 | — | 4 |
| 52 | 53 | 10 | 4.7 | 0.3 | — | 5 |
| 53 | 54 | 10 | 4.8 | 0.3 | — | 5 |
| 54 | 55 | 7.5 | | 0.338 | — | 5 |
| 55 | 56 | 10 | 5.3 | 0.3 | DOWANOL PM (9%) | 4 |
| 56 | 57 | 10 | 4.6 | 0.3 | — | 4 |
| 57 | 58 | 10 | 7.5 | 0.3 | — | 4 |
| 58 | 59 | 10 | 7.4 | 0.3 | — | 3 |
| 59 | 60 | 5.5 | 6.1 | 0.3 | — | 5 |
| 60 | 60 | 5.5 | 6.1 | 0.3 | — | 5 |
| | + TMOS | 24 | 2.0 | 0.24 | — | 5 |

TABLE 2-continued

| Invention example number | Binder number(s) | Binder added to siver behenate emulsion: solids wt % in medium in which binder is added | pH of binder dispersion | quantity of binder added [g] | Emulsion layer additive(s) | Image quality obtained after image-wise exposure and thermal processing |
|---|---|---|---|---|---|---|
| 61 | 61 | 5 | 7.7 | 0.3 | — | 3 |
| 62 | 62 | 5 | 4.5 | 0.3 | — | 4 |
| 63 | 63 | 5 | 5.8 | 0.3 | — | 3 |
| 64 | 64 | 5 | 6.5 | 0.3 | — | 3 |

The image quality results given in table 2 show that photothermographic silver behenate emulsion layers coated from aqueous media with water-soluble and water-dispersible polymers exhibit considerably improved image quality compared with those coated from aqueous media with gelatin as binder as taught by the state of the art.

Silver behenate photothermographic emulsion layers coated from aqueous media with styrene-containing, diene-containing and (meth)acrylate-containing copolymers as binders exhibit particularly good image qualities.

INVENTION EXAMPLE 65

A sodium behenate solution was prepared by first dissolving 34 kg of behenic acid in 340 L of isopropanol at 65° C. and then adding with stirring a 0.25 N solution of sodium hydroxide until a solution pH of 8.7 was obtained. This required about 400 L of 0.25 N NaOH. The concentration of the resulting solution was then adjusted to a sodium behenate concentration of 8.9% by weight and a concentration of isopropanol in the solvent mixture of 16.7% by volume, by a combination of evaporation and dilution.

The silver behenate synthesis was carried out in the absence of light at a constant UAg of 400 mV as follows: to a stirred solution of 30 g of GELATIN 01 in 750 mL of distilled water at 72° C. in a double walled reactor, several drops of a 2.94 M aqueous solution of silver nitrate were added to adjust the UAg at the start of the reaction to 400 mV and then 374 mL of the sodium behenate solution, whose preparation is described above, at a temperature of 78 ° C. was metered into the reactor at a rate of 46.6 mL/min and simultaneously a 2.94 M aqueous solution of silver nitrate was metered into the reactor, its addition rate being controlled by the quantity of the silver nitrate solution necessary to maintain a UAg of 400±5 mV in the dispersing medium in the reactor. Both the sodium behenate and silver nitrate solutions were added to the dispersing medium via small diameter tubes positioned just under the surface of the dispersing medium.

By the end of the addition step 0.092 moles of sodium behenate and 0.101 moles of silver nitrate had been added. The mixture was then stirred for a further 30 minutes.

To this dispersion at 72° C. was added dropwise with stirring an aqueous solution 2.94 molar in halide, made up of 95% by weight of potassium bromide and 5% by weight of potassium iodide, until a UAg of 225 mV was attained. This process required 7.5 mL of the halide solution, whereby silver bromide and silver iodide were formed and the free silver ion concentration was strongly reduced. In this process some of the silver behenate may also have been converted into silver halide. After halide solution addition, the reaction mixture was stirred for a further 30 minutes at 72° C. The dispersion obtained after this step contained 0.079 moles of silver behenate and 0.022 moles of silver halide.

To 10 g of this silver behenate/silver halide dispersion, 0.014 g of succinimide and 1 mL of a 30% by weight aqueous dispersion of BINDER 02 were added. The resulting dispersion was coated at a temperature of 40 ° C., using a doctor blade coater with a slit-width of 120 μm, onto a subbed 100 μm thick polyester sheet. After drying the layers were coated with a 3.9% aqueous solution of 3,4-dihydroxyphenylpropionic acid using a doctor blade coater with a slit-width of 50 μm. After drying the resulting photothermographic material was image-wise exposed, thermally developed and the resulting image evaluated as described for COMPARATIVE EXAMPLE 1 except that the heating was carried out at 85° C. for 30 s instead of at 95° C. for 10 s. A good quality image was obtained with a low fog density meriting a numerical score of 4.

INVENTION EXAMPLE 66

The photothermographic recording material of invention example 66 was produced as described for invention example 65 except that the 1 mL of a 30% by weight aqueous dispersion of BINDER 02 was replaced by 1 mL of a 25% by weight aqueous dispersion of BINDER 22.

After drying the resulting photothermographic recording material was image-wise exposed, thermally developed and the image evaluated as described for INVENTION EXAMPLE 65. Similar photographic results were obtained to the photothermographic recording material of INVENTION EXAMPLE 65.

INVENTION EXAMPLE 67

The photothermographic recording material of invention example 65 was produced as described for invention example 63 except that the 1 mL of a 30% by weight aqueous dispersion of BINDER 02 was replaced by 1 mL of a 20% by weight aqueous dispersion of a BINDER 23.

After drying the resulting photothermographic recording material was image-wise exposed, thermally developed and the image evaluated as described for INVENTION EXAMPLE 65. Similar photographic results were obtained to the photothermographic material of INVENTION EXAMPLE 65.

INVENTION EXAMPLE 68

The photothermographic recording material of invention example 68 was produced as described for invention example 65 except that the 1 mL of a 30% by weight aqueous dispersion of a terpolymer consisting of BINDER 02 was replaced by 1 mL of BINDER 53.

After drying the resulting photothermographic recording material was image-wise exposed, thermally developed and the image evaluated as described for INVENTION EXAMPLE 65. Similar photographic results were obtained to the photothermographic material of INVENTION EXAMPLE 65.

INVENTION EXAMPLE 69

In situ preparation of a silver behenate/silver halide-emulsion

Silver behenate was prepared by dissolving 34 g (0.1 moles) of behenic acid in 340 mL of 2-propanol at 65° C., converting the behenic acid to sodium behenate by adding 400 mL of 0.25 M aqueous sodium hydroxide to the stirred behenic acid solution and finally adding 250 mL of 0.4 M aqueous silver nitrate the silver behenate precipitating out. This was filtered off and then washed with a mixture of 10% by volume of 2-propanol and 90% by volume of deionized water to remove residual sodium nitrate.

After drying at 45° C. for 12 h, the silver behenate was dispersed in deionized water with the anionic dispersion agents Ultravon™ W and Mersola™ H to produce after rapid mixing to a predispersion and homogenization with a microfluidizer a finely divided and stable dispersion containing 20% by weight of silver behenate, 2.1% by weight of Ultravon™ W and 0.203% by weight of Mersolat™ H. The pH of the resulting dispersion was adjusted to about 6.5.

The following ingredients were then added with stirring to 1.5 g of the silver behenate dispersion: 1 g of a 30% by weight concentration of BINDER 01, 0.013 g of succinimide, 0.1 g of a 11% by weight solution of saponin in a mixture of deionized water and methanol and 2.4 g of a 1.28% by weight aqueous solution of 3-(triphenylphosphonium)propionic acid bromide perbromide (PC01), corresponding to a concentration of 8 mol % of PC01 with respect to silver behenate, to accomplish in situ conversion of part of the silver behenate to silver bromide.

Transmission electron micrograph of the resulting silver behenate/silver bromide dispersion The transmission electron micrograph of the resulting dispersion produced at a magnification of 50,000x (1 cm=200 nm) is shown in FIG. 1. The large rod-shaped particles are silver behenate. The very small black particles, ≦40 nm in diameter, uniformly distributed over these silver behenate particles and also uniformly distributed between these particles are silver bromide particles.

Coating and drying of the photothermographic material

A subbed polyethylene terephthalate support having a thickness of 100 μm was doctor blade-coated with the silver behenate/silver bromide dispersion at a blade setting of 60 μm. After drying for several minutes at 40° C. on the coating bed, the emulsion layer was then doctor blade-coated with a 2.44% by weight aqueous solution of 3-(3,4-dihydroxyphenyl)propionic acid at a blade setting of 30 μm. The resulting thermographic material was first allowed to dry on the coating bed for several minutes at 40° C. and then was dried for 1 hour in a hot air oven at 50 ° C.

Image-wise exposure and thermal processing

The resulting photothermographic recording material was then image-wise exposed, thermally developed and the image evaluated as described for COMPARATIVE EXAMPLE 1. A very good image with a high contrast and good sharpness was obtained which was awarded a score of 5.

INVENTION EXAMPLE 70

The material of invention example 70 was prepared as described for invention example 69 except that the binder used was changed, 1 g of a 30% by weight concentration of BINDER 02 being used instead of a 30% by weight concentration of BINDER 01. Image-wise exposure and thermal processing of the resulting material, as described for COMPARATIVE EXAMPLE 1, produced a very good image with a high contrast which was awarded a score of 5 for image quality as in the case of the material of invention example 69.

INVENTION EXAMPLE 71

The material of invention example 71 was prepared as described for invention example 69 except that the binder used was changed, 1 g of a 30% by weight concentration of BINDER 03 being used instead of a 30% by weight concentration of BINDER 01. Image-wise exposure and thermal processing of the resulting material, as described for COMPARATIVE EXAMPLE 1, produced a very good image with a high contrast which was awarded a score of 5 for image quality as in the case of the material of invention example 69.

Having described in detail preferred embodiments of the current invention, it will now be apparent to those skilled in the art that numerous modifications can be made therein without departing from the scope of the invention as defined in the following claims.

We claim:

1. A process for producing a black and white photothermographic recording material, said recording material including a support and a photo-addressable thermally developable element containing a photosensitive silver halide in catalytic associate with a substantially light-insensitive silver salt of a fatty acid, an organic reducing agent for said substantially light-insensitive silver salt of said fatty acid in thermal working relationship therewith and a water-insoluble polymer latex binder, said process comprising the steps of: (i) producing an aqueous dispersion or aqueous dispersions containing said photosensitive silver halide, said substantially light-insensitive silver salt of said fatty acid, said organic reducing agent and said polymer latex binder; and (ii) coating said aqueous dispersion or aqueous dispersions onto a support; wherein the medium for said aqueous dispersion or dispersions is selected from the group consisting of water and mixtures of water and water-miscible organic solvents.

2. Process according to claim 1, wherein said polymer latex is selected from the group consisting of: an aqueous dispersion of a terpolymer consisting of 47.5% by weight of methylmethacrylate, 47.5% by weight of butadiene and 5% by weight of itaconic acid; an aqueous dispersion of a terpolymer consisting of 50% by weight of ethylacrylate, 33.5% by weight of methylmethacrylate and 16.5% by weight of methacrylic acid; and an aqueous dispersion of a copolymer consisting of 95% by weight of ethylacrylate and 5% by weight of methacrylic acid.

3. Process according to claim 1, wherein said polymer latex includes monomer units selected from the group consisting of a diene-monomer and a methacrylate.

4. Process according to claim 1, wherein said polymer latex includes monomer units selected from the group consisting of a styrene and an acrylate.

5. Process according to claim 1, wherein said photo-addressable thermally developable element is provided with a protective layer.

6. Process according to any of the preceding claims, wherein said photo-addressable thermally developable element further contains a dye with maximum absorbance in the wavelength range 600 to 1100 nm.

7. Process according to claim 1, wherein the concentration of said photosensitive silver halide is 0.1 to 35 mol percent of said substantially light-insensitive silver salt of an organic carboxylic acid.

8. A photothermographic recording process comprising (a) image-wise exposing a black and white photothermographic recording material to a source of actinic radiation to which said photothermographic recording material is sensitive, and (b) thermally developing said image-wise exposed photothermoraphic recording material, wherein said black and white photothermographic recording material comprises a support and a photo-addressable thermally developable element containing a photosensitive silver halide in catalytic association with a substantially light-insensitive silver salt of a fatty acid, an organic reducing agent for said substantially light-insensitive silver salt of said fatty acid in thermal working relationship therewith and a water-insoluble polymer latex binder, said photothermographic recording material being produced by the steps of:

(I) producing an aqueous dispersion or aqueous dispersions containing said photosensitive silver halide, said substantially light-insensitive silver salt of said fatty acid, said organic reducing agent and said polymer latex binder; and (II) coating said aqueous dispersion or aqueous dispersions onto said support, wherein the medium for said aqueous dispersion or dispersions is selected from the group consisting of water and mixtures of water and water-miscible organic solvents.

9. A process for producing a black and white photothermographic recording material, said recording material including a support and a photo-addressable thermally developable element containing a photosensitive silver halide in catalytic association with a substantially light-insensitive silver salt of a fatty acid, an organic reducing agent for said substantially light-insensitive silver salt of said fatty acid in thermal working relationship therewith and a water-insoluble polymer latex binder containing monomer units selected from the group consisting of a diene monomer, an acrylate monomer, a styrene monomer and mixtures thereof, said process comprising the steps of: (i) producing an aqueous dispersion or aqueous dispersions containing said photosensitive silver halide, said substantially light-insensitive silver salt of a fatty acid, said organic reducing agent and said polymer latex binder; and (ii) coating said aqueous dispersion or aqueous dispersions onto a support; wherein the medium for said aqueous dispersion or dispersions is selected from the group consisting of water and mixtures of water and water-miscible organic solvents.

* * * * *